United States Patent [19]

Altenau et al.

[11] Patent Number: 4,524,696

[45] Date of Patent: Jun. 25, 1985

[54] EXPLOSIVE SHRAPNEL SHELL

[75] Inventors: Ernst-Wilhelm Altenau, Duisburg; Ulf Hahn, Hösel; Udo Sabranski, Willich, all of Fed. Rep. of Germany

[73] Assignee: Rheinmetall GmbH, Duesseldorf, Fed. Rep. of Germany

[21] Appl. No.: 510,930

[22] Filed: Jul. 5, 1983

[30] Foreign Application Priority Data

Jul. 2, 1982 [DE] Fed. Rep. of Germany ..... 3224704

[51] Int. Cl.[3] ..... F42B 13/18

[52] U.S. Cl. ..... 102/491; 102/473

[58] Field of Search ..... 102/389, 491–497, 102/473, 506

[56] References Cited

U.S. PATENT DOCUMENTS

| | | | |
|---|---|---|---|
| 94,647 | 9/1869 | Richards | 102/497 |
| 911,008 | 1/1909 | Heldt | 102/497 |
| 4,129,061 | 12/1978 | Bedall et al. | 102/496 X |
| 4,303,015 | 12/1981 | Bourlet | 102/492 |

FOREIGN PATENT DOCUMENTS

| | | | |
|---|---|---|---|
| 1237195 | 6/1960 | France | 102/494 |
| 54027 | 6/1934 | Norway | 102/494 |

*Primary Examiner*—Harold J. Tudor

[57] ABSTRACT

An explosive shrapnel shell has a bursting charge having a front end, a layer of shrapnel laterally surrounding the charge except at the end, a fuse mounted on the front end, and shrapnel in the fuse. The fuse includes a detonator charge lying between the fuse shrapnel and the bursting charge. The shell is generally centered on an axis extending through the front end and the fuse includes an axially rearwardly extending tube. The detonator charge is in and axially behind the tube and the fuse shrapnel form a ring circumferentially surrounding the tube. An intensifying charge can lie between the detonator charge and the bursting charge.

7 Claims, 3 Drawing Figures

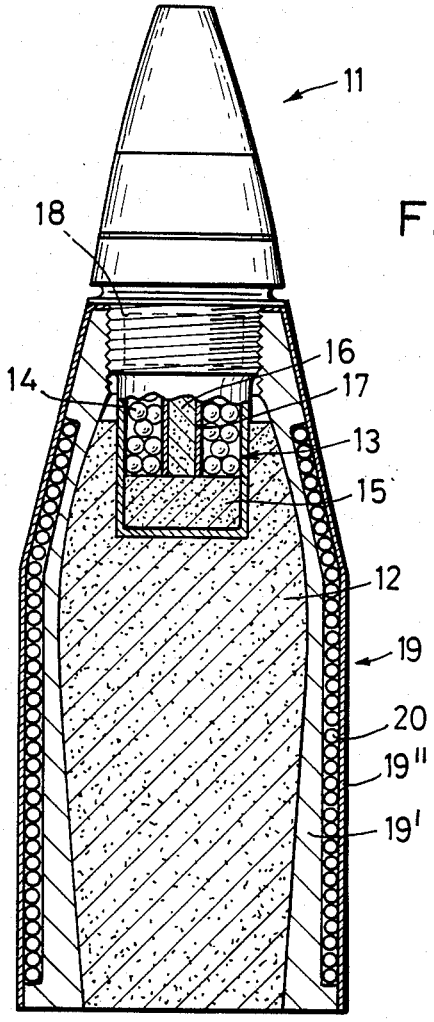
FIG.1
FIG.2
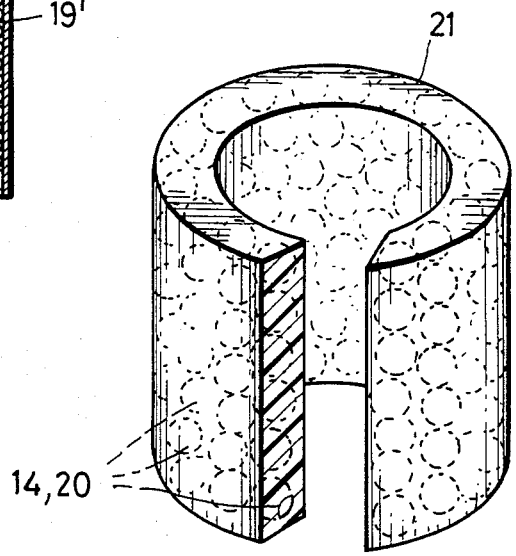

EXPLOSIVE SHRAPNEL SHELL

FIELD OF THE INVENTION

The present invention relates to a projectile or shell that is fired from a gun. More particularly this invention concerns an explosive shrapnel shell.

BACKGROUND OF THE INVENTION

An exploding shrapnel shell, such as described in German patent document No. 2,518,044, has a shrapnel-lined or -forming case surrounding a bursting charge and provided at its tip with a fuse. Whether of the impact, proximity, or timer-controlled type, this fuse incorporates a detonating or primer charge that is exploded to in turn explode the bursting charge, usually with some sort of safety provided to prevent inadvertent actuation of the fuse.

The main problem with this type of projectile is that the shrapnel is principally distributed around the center of the shot. This is essentially caused by the absence of any shrapnel elements forward of the bursting charge, as the tip of the shell carries the fuse. Hence the area at the center of the shot is usually inadequately peppered with shrapnel or splinters.

OBJECTS OF THE INVENTION

It is therefore an object of the present invention to provide an improved explosive shrapnel shell.

Another object is the provision of such an explosive shrapnel shell which overcomes the above-given disadvantages, that is which has a uniform shrapnel pattern.

SUMMARY OF THE INVENTION

An explosive shrapnel shell according to the invention has a bursting charge having a front end, a layer of shrapnel laterally surrounding the charge except at the end, a fuse mounted on the front end, and shrapnel in the fuse. The fuse includes a detonator charge lying between the fuse shrapnel and the bursting charge. The shell is generally centered on an axis extending through the front end and the fuse includes an axially rearwardly extending tube. The detonator charge is in and axially behind the tube and the fuse shrapnel form a ring circumferentially surrounding the tube.

According to this invention an intensifying charge can lie between the detonator charge and the bursting charge.

The shrapnel can be formed by a splintering casing, but the fuse shrapnel are a multiplicity of balls of a heavy metal such as tungsten or an alloy thereof. This fuse shrapnel is imbedded and carried in an at least limitedly flexible synthetic-resin support body to make assembling the shell relatively easy.

It is also possible according to this invention for the fuse to include a safety lying between the fuse shrapnel and the bursting charge.

DESCRIPTION OF THE DRAWING

The above and other features and advantages will become more readily apparent from the following, reference being made to the accompanying drawing in which:

FIG. 1 is an axial section through the front region of an explosive shrapnel projectile according to this invention;

FIG. 2 is a perspective view of a detail of FIG. 1; and

SPECIFIC DESCRIPTION

Figure 3:
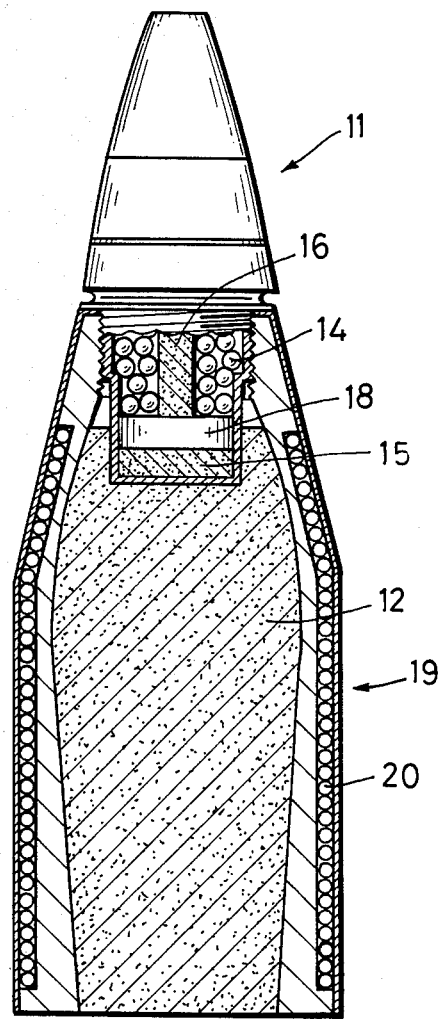
FIG. 3 is a view like FIG. 1 through another shell in accordance with this invention.

As seen in FIG. 1 a shell according to this invention is centered on an axis A and has at its front end a fuse 11 and therebehind a bursting charge 12. A casing 19 laterally surrounds the charge 12 and has an inner layer 19', a layer of shrapnel balls 20, and an outer layer 19''.

The fuse 11 has at its rear side a safety 18 and therebehind is provided with an axially rearwardly extending tube 17 in which is provided a detonating charge 16. An intensifying charge 15 is provided between the rear end of the charge 16 and the front end of the charge 12.

According to this invention an annular multilayer array of shrapnel balls 14 imbedded in a split synthetic-resin sleeve 21 surrounds the tube 17 and therefore lies ahead of the bursting charge 12 and part of the detonator charge 16.

Thus when the charge 12 is exploded, the balls 14 lying ahead of its center C on the axis A will be propelled forward while the balls 20 will be propelled radially outward. As a result a uniform pattern, filled directly in line with the shell, is produced.

The shell according to this invention can be made rather inexpensively by imbedding one or several layers of the balls 14 or 20 in a split sleeve such as shown at 21 in FIG. 1. This sleeve makes properly positioning the shrapnel balls easy.

It is also possible as shown in FIG. 3 to position the safety 18 behind the fuse shrapnel balls 14. In this arrangement the charge 16 an tube 17 are not needed.

The balls 14 and 20 according to this invention are made of tungsten, a very dense metal.

We claim:

1. An improved shrapnel shell having an interior wall, an ignition fuse, and an outer shrapnel multilayer which layer laterally surrounds a bursting charge, the improvement comprising (a) said ignition fuse forming the nose of the shell and having a cylindrical rearwardly axially extending portion having an outer cylindrical wall containing second shrapnel which portion defines a first annular space between its outer cylindrical wall and the interior wall of the shell;

(b) said bursting charge disposed in said shell and extending into said first annular space;

(c) a coaxial detonating charge extending through at least a portion of said cylindrical portion defining a second annular space containing the second shrapnel; and (d) an intensifying charge mounted in said cylindrical portion and having a higher specific energy that said bursting charge and being disposed behind said tube and said second shrapnel and extending across the entire cross-section of said cylindrical portion.

2. The explosive shrapnel shell defined in claim 1, wherein said intensifying charge is disposed between the detonator charge and the bursting charge.

3. The explosive shrapnel shell defined in claim 1 wherein the second fuse shrapnel is a multiplicity of balls.

4. The explosive shrapnel shell defined in claim 3 wherein the balls are of a heavy metal.

5. The explosive shrapnel shell defined in claim 4 wherein the heavy metal is tungsten.

6. The explosive shrapnel shell defined in claim 1 wherein the second fuse shrapnel is imbedded and carried in an at least limitedly flexible synthetic-resin support body.

7. The explosive shrapnel shell defined in claim 1 wherein the fuse includes a safety lying between the fuse shrapnel and the bursting charge.

* * * * *